United States Patent [19]

Burrell

[11] Patent Number: 4,869,026

[45] Date of Patent: Sep. 26, 1989

[54] SANDER

[75] Inventor: Leo L. Burrell, Beaver, Pa.

[73] Assignee: Leonard L. Burrell, Willis, Mich. ; a part interest

[21] Appl. No.: 167,022

[22] Filed: Mar. 11, 1988

[51] Int. Cl.[4] ..... B24B 21/00

[52] U.S. Cl. ..... 51/135 R; 51/148; 51/170 EB

[58] Field of Search ..... 51/135 R, 148, 170 EB, 51/241 S

[56] References Cited

U.S. PATENT DOCUMENTS

| | | | |
|---|---|---|---|
| 1,773,077 | 8/1930 | Newman | 51/170 EB |
| 2,556,041 | 6/1951 | Pick | 51/170 EB |
| 2,751,728 | 6/1956 | Petit | 51/170 EB X |
| 3,267,619 | 8/1966 | Den Herder | 51/148 |
| 3,983,664 | 10/1976 | Martin | 51/170 EB |
| 4,043,083 | 8/1977 | Rosdil | 51/170 EB |
| 4,551,951 | 11/1985 | Nace | 51/170 EB |

*Primary Examiner*—James G. Smith
*Attorney, Agent, or Firm*—William J. Ruano

[57] ABSTRACT

A belt sander having a continuous belt whose grit faces inwardly toward the centrum of the space encompassed by the belt. The sander is powered by electric motor means such as an electric drill motor. Its function is to de-burr, sand, or polish metal or wood work pieces to a cylindrical or curved shape. Its action is to encompass the work piece with a moving belt whose inward facing surface is coated or covered by the desired abrasive or polishing material, and to cause contact between the belt and the work piece to remove or add material. Spring pressure is normally applied between the driving shaft or pulley and the frictionally driven belt to prevent or minimize slip when the driven belt sands a pipe or other curved surface. The sander is constructed so as to be selectively portable or stationary mounted on a table. It may also be driven by a chain saw.

9 Claims, 3 Drawing Sheets

SANDER

This invention relates to a selectively portable or stationary power driven sanding device.

BACKGROUND OF THE INVENTION

Presently, sanding devices of practically all types effect sanding on flat surface, such as by a sanding disc or belt. An outstanding disadvantage of such devices is that in many applications, particularly those for sanding rounded or even cylindrical surfaces, it is not possible to do so effectively with common types of sanders since they do not readily conform to curved surfaces sought by the workman. Moreover, it is difficult or even impossible with presently known sanders to sand the entire surface of a pipe that is mounted closely adjacent a wall because of the small space therebetween. Also, present sanders are not readily convertible from a portable type to one that is rigidly mounted on the workbench.

Partially rounded workpieces typified by the necks of musical instruments may be fastened face-to-face in order to prevent imbalance while rough shaping their back side in a wood lathe. But finishing cannot be done on a lathe because (1) colorfully grained woods used in musical instruments have irregular grain which tends to tear laterally against the lifting action of a lathe tool; (2) the final shape is almost never a "segment of a circle".

Instrument necks can also be shaped using high-speed routing machines. These machines are too expensive for entrepreneur instrument builders. Hand-made necks are often shaped with planes, draw knives and hand-held sanding blocks which are either slow or dangerous.

Tanks and other round vessels including piping used in industry, often are sand-blasted in preparation for re-coating. The equipment used in the sand-blasting operation is expensive due to the need for parts to withstand the abrasive action of the sand. And most of the sand used in the process cannot be re-claimed due to contamination. And the process is dangerous to the worker and to the environment.

There currently is no tool available to economically and safely work the surface of round/elliptical shapes.

SUMMARY OF THE PRESENT INVENTION

An object of the present invention is to overcome the above-named disadvantages of presently used sanders and to provide a novel sander which is selectively portable, or fixed on the workbench, and which includes a sanding belt that partially encompasses the object to be sanded, whether fixed or movable, and which sander may be readily converted from one that is portable to one that is fixed or permanently mounted on a workbench.

Another object of the invention is to overcome the tendency of slipping of an endless belt relative to its drive shaft by applying a constant yield spring pressure.

The main disadvantage of present belt sanders having the grit facing inwardly is that the belt must be engaged with the workpiece in order to provide friction between the belt and the driving spool. In cases where the friction between the belt and workpiece is greater than that between belt and driver, the belt will slip and abrade the driver rather than the workpiece.

In the present invention, friction is caused between the driver and the belt by an external force of a spring loaded pressure plate or pressure roller. This reduces said tendency to slip. The belt revolves about the workpiece with no contact at all, thus setting a minimum required belt/workpiece initial friction at zero psi. No break loose force is required. The driver spool may be driven indirectly either by a portable drill motor or a chain saw or it may be coupled to an internally located gas turbine or electric motor to provide a "self powered" tool.

DESCRIPTION OF THE PREFERRED EMBODIMENTS

Figure 1:
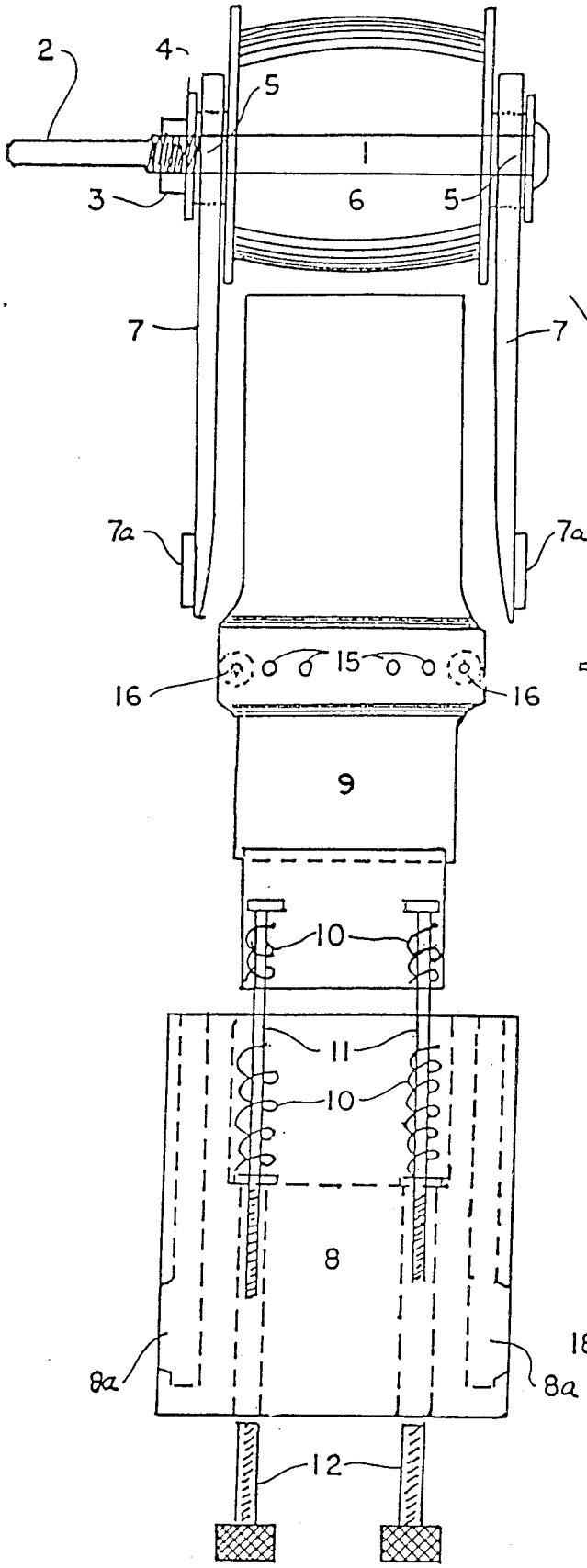
FIG. 1 is a top or plan exploded view of a centerless sander embodying the present invention.
Figure 2:
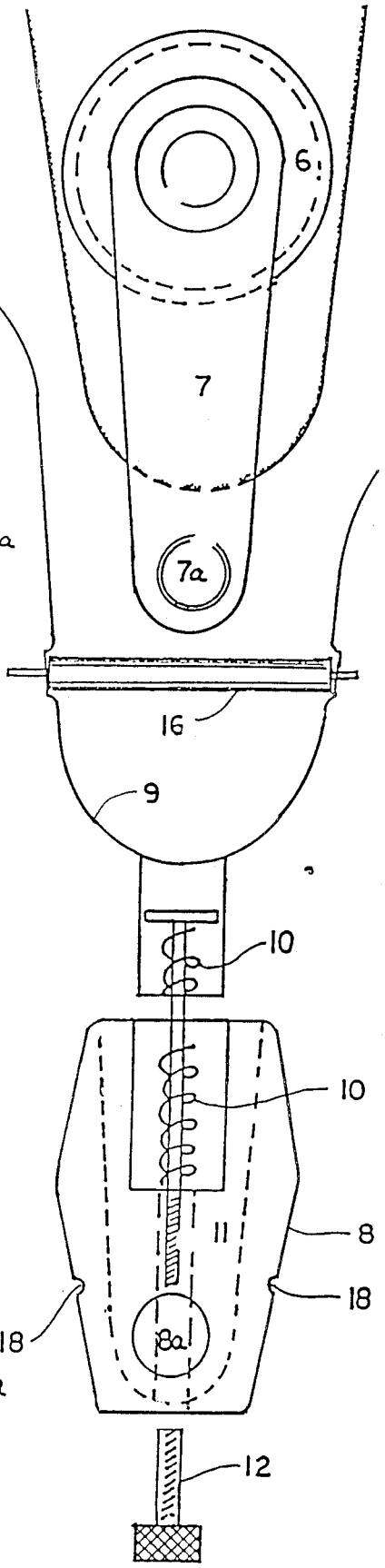
FIG. 2 is a side view thereof.

Referring more particularly to FIGS. 1 and 2, numeral 1 denotes an arbor or shaft having a driving extension 2 which may be driven by the chuck of a well known portable variable speed drill motor (not shown). A hexagonal nut 3 in threaded to extension 2. A washer 4 is provided. Shaft 1 is rotably mounted on bearing 5,5 adjoining washer 4, in a pair of extensions 7,7 slidably mounted in the sides of body 8, preferably of plastic or metal having outwardly extending cylindrical lateral extensions 7*a*, fitting into holes 8*a*.

An important feature of the present invention is outwardly flared pressure plate 9, preferably of spring steel or possibly of plastic material, which yieldably engages the rounded periphery of a spool 6, preferably of solid rubber, by virtue of a pair of springs 10,10 in a well portion of said body surrounding the shanks of bolts 11 having threads screw threadedly engaging the internal threads of spring adjusting caps 12 for adjustably varying the tension of springs 10,10 and the extent of spring pressure applied by pressure plate 9 of U-shaped cross section against the endless and centerless belt B which is internally coated with abrasive material.

The side edges of belt B are guided by a pair of guide roller bearings 16 which are adjustably mounted by their pins in selective slots 15 in the outwardly flared sides of pressure plate 9 so as to accomodate belts of different widths.

While a pair of adjustable pressure screw caps 12 are shown, a single central screw cap may be used, instead, or perhaps additional caps to the two shown.

The body 8 may be used as a handle when sanding or, instead, suitable extensions (not shown) may be provided on the body 9 to better serve in firmly holding it.

Figure 7:
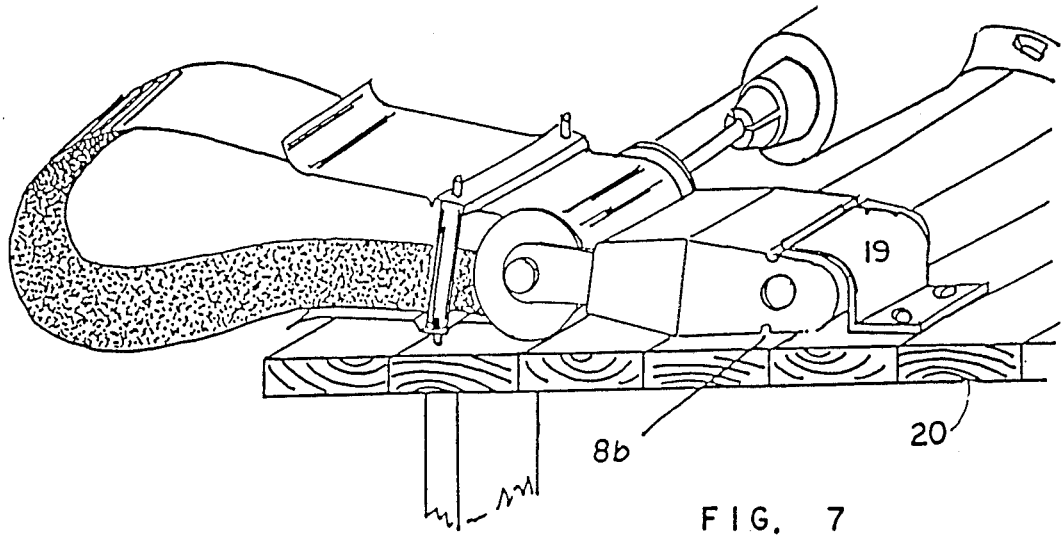
FIG. 7 is a top perspective view of a table mounted drill attachment.

While body 8 may be portably held, it may be permanently mounted, instead, on a work bench as shown in FIG. 7. An easy way to accomplish this is to form a pair of grooves 8*b* on opposite sides of body 8 which will fit into springy extensions of a springy metallic mounting plate 19 rigidly attached to the top surface of a work bench 20.

Figure 3:
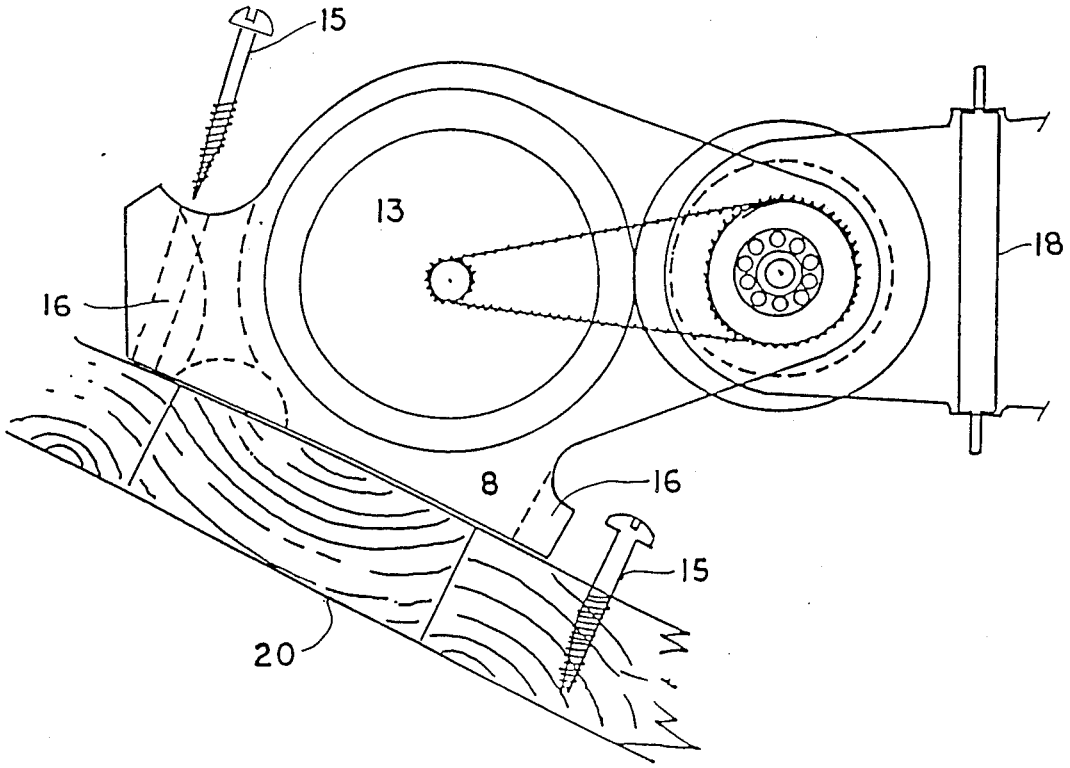
FIG. 3 is a side view of a modification in the form of a self powered portable sander with bench mounting capability.
Figure 4:
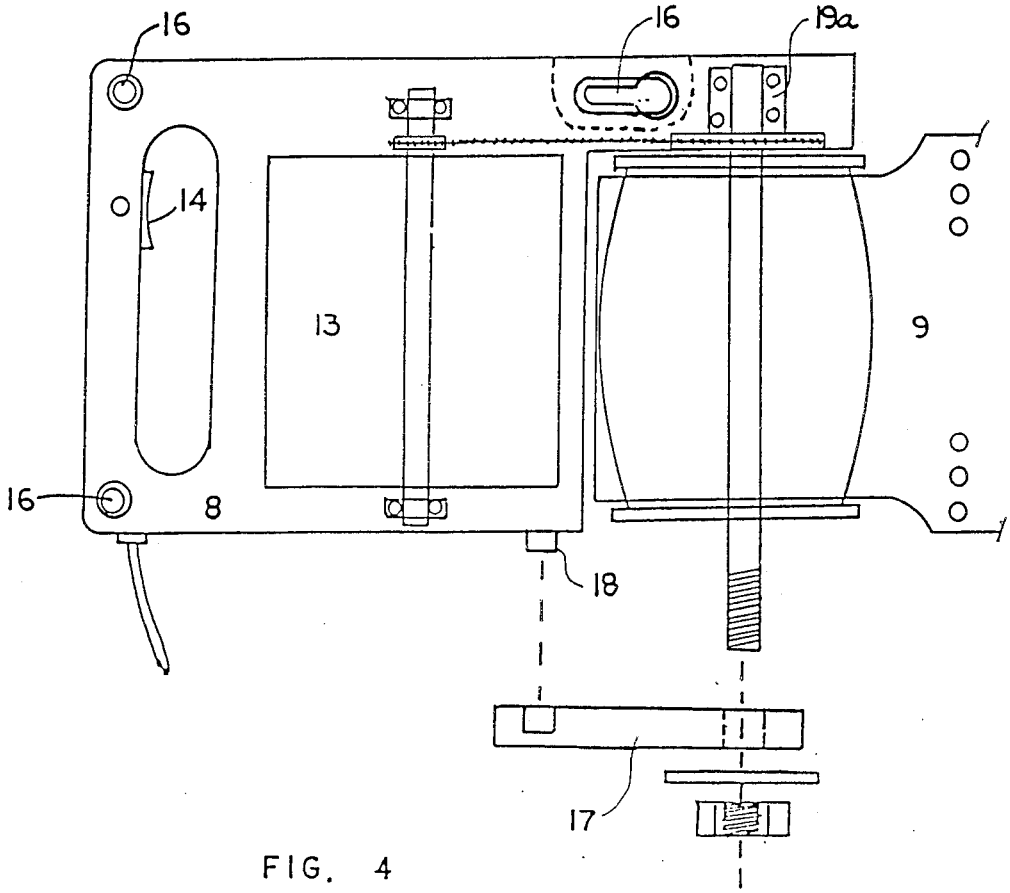
FIG. 4 is a plan view thereof showing a second method of letting a continuous belt into the sander.
Figure 5:
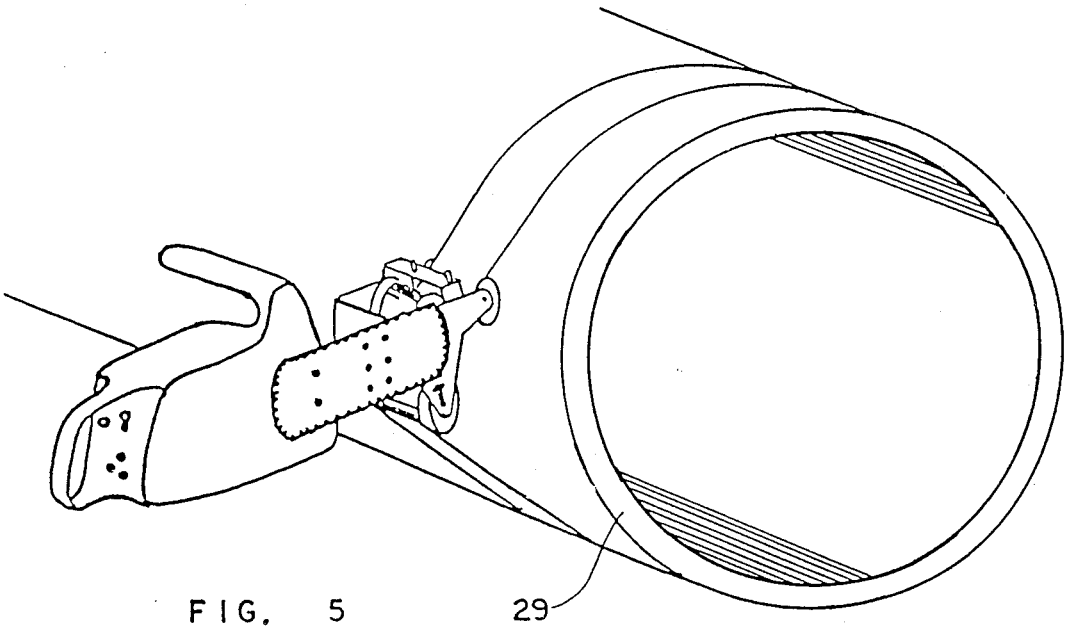
FIG. 5 is a top perspective view of a modification driven by a chain saw drive.

A third embodiment of the invention is a self-powered portable sander as shown in FIG. 3 and FIG. 4. This tool may be powered by electricity or air, and needs no driver such as shown in FIG. 5 and FIG. 7. Referring to FIGS. 3 and 4, numeral 13 is a driver powered by electricity or air. Power is controlled by a variable rate switch 14 to increase or decrease the rate of work. One method of attaching this portable tool to a bench 20 utilizes screws 15 through body holes 16.

A second method of letting a continuous belt over the drive spool 6 utilizes a removable member 17 which attaches to the body 8 at guide pin 18. A double race bearing 19*a* provides stability to the assembly during belt changing operations.

Figure 6:
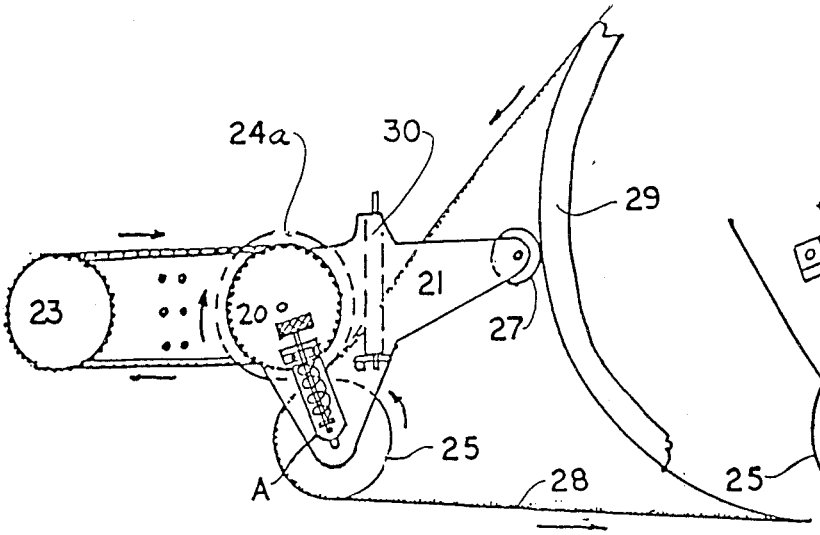
FIG. 6 is an enlarged view of a portion of FIG. 5.
Figure 6A:
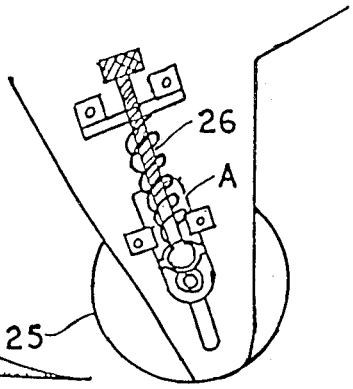
FIG. 6*a* is a further enlarged view of a portion of Fig6.

FIG. 6 is a centerless sander unlike that described above in the manner of increasing and decreasing friction between the drive spool 24*a* and the work belt 28. A pressure spool 25 having adjustable spring tensioning assemblies 26 (FIG. 6*a*) at both ends of the spool provides variable pressure against the belt and the drive spool. The pressure can be unevenly applied so as to "center" the belt on the spools.

The reference rollers are held against the workpiece 29 and the chainsaw is tipped down to relieve pressure of the work belt against the workpiece,-pressure being added by lifting the chainsaw.

Referring to FIG. 6, the chain saw sprocket 23 drives the adaptive chain over the adaptive chain bar assembly 21 in the direction indicated. The driver sprocket 20 is firmly attached to the belt drive spool 24a. The work belt 28 is captured between the drive spool 24a and the pressure spool 25. This permits movement of the work belt with very little friction as seen in FIG. 6, or with increased friction by raising the extreme handle of the chainsaw.

The chainsaw bar assembly is like an ordinary chainsaw bar in its attachment to the chainsaw. It has a side-arm to support the bar side of the rollers. This side-arm may be made adjustable or of variable lengths to support the use of various belt widths, but, with the ability to "center" a belt on the spools, one length to fit the widest currently used belt would be preferred. The reference rollers 27 serve to apply leverage of the tool against the workpiece. The guide rollers 30 guide the work belt onto the spools to prevent fretting the bar. A better view of the bar without attachments reveals a slot that the pressure spool bearings travels in.

A pressure adjustment assembly 26 is provided. A handle is fixed to a threaded rod which threads into a bracket which is attached to the bar. The rod passes through a spring, and after the spring to a flared loose end. Movement of the handle compresses or expands the spring to apply more or less pressure between the spools. The drive spool bearing attaches to the bar; the pressure spool bearing to the moveable "spring can".

Thus it can be seen that the friction can be added or relieved: (1) to hold the belt firmly in the sander, (2) to hold the belt in the center of the drive and pressure spools.

The advantages of the present invention are (1) portability. This tool is independent of electricity and extension cords. (2) power. This tool can be adapted to chainsaws capable of performing a variety of field tasks.

I claim:

1. A belt sander attachment comprising a substantially U-shaped portion including a pair of parallel arms, said arms having bearings through which a spindle extends for rotation by a portable electric drill motor, or the like, and including a spool between said arms encircling and driven by said spindle, an endless belt driven by said spindle and being of substantially greater length than the perimeter of said spool and having an inner abrasive surface, a pressure plate of substantially U-shape with outwardly flared terminal portions surrounding a portion of said spindle and belt, and spring means in a well portion of said body portion exerting spring pressure on said pressure plate which, in turn, exerts constant frictional pressure against the outer surface of said belt, whereby slipping of said belt on said spindle under substantial frictional loading between the belt and sanded work piece is practially eliminated.

2. Apparatus recited in claim 1 together with means for adjusting the spring pressure exerted by said spring means.

3. Apparatus as recited in claim 1 wherein said pressure plate has a radial extension, said body portion having a recess for receiving said extension and for exerting spring pressure on said extension and said pressure plate.

4. Apparatus as recited in claim 1 together with adjustable guide means mounted on both sides of said pressure plate for guiding the sides of said endless belt.

5. Apparatus as recited in claim 4 wherein said adjustable guide means comprises spaced holes transversely of said terminal portions of said pressure plate and a pair of pins, one on each side of said belt for selective insertion in said spaced holes to accomodate different belt widths.

6. Apparatus as recited in claim 1 together with a slot extending along the outside of said body portion, and a work table having a resilient clamp extending upwardly for engagement with said slot to provide a fixed instead of portable sander.

7. Apparatus as recited in claim 1 wherein said body portion having external holes, said parallel arms including relatively slidable portions including terminal projections detachably fitted into said holes to lock said arms to said body portion.

8. A belt sander attachment for driving an endless belt having an abrasive inner surface for sanding outer curved surfaces, a portable motor for driving a spool which frictionally drives said inner surface of said belt, and adjustable spring pressure means including a substantially U-shaped pressure, springy plate having outwardly turned extremities and having an inner surface for applying constant friction to the outer surface of said belt while it is being driven, to minimize slip.

9. An attachment as recited in claim 8 driven by the motor of a portable drill.

* * * * *